United States Patent [19]

Battersby

[11] 4,274,275

[45] Jun. 23, 1981

[54] METHOD OF FORMING A CORRUGATED ANNULUS

[76] Inventor: Edward Battersby, 229 High St., Cumberland, R.I. 02864

[21] Appl. No.: 22,603

[22] Filed: Mar. 21, 1979

[51] Int. Cl.[3] ..... B21D 13/10

[52] U.S. Cl. ..... 72/307; 72/381; 113/116 D

[58] Field of Search ..... 72/306, 307, 311, 381, 72/384, 406; 113/116 D

[56] References Cited

U.S. PATENT DOCUMENTS 2,152,523 3/1939 McGuire ..... 113/116 D 2,481,049 9/1949 Stamm et al. ..... 72/381

*Primary Examiner*—Lowell A. Larson

*Attorney, Agent, or Firm*—Barlow & Barlow

[57] ABSTRACT

A method of producing a corrugated annulus is disclosed which has substantially radial folds therein, the method consisting essentially of forming in one continuous straight piece of metal a curved or arcuate head for a reel or the like which method consists in forming a number of radial folds extending from one edge of the strip to the other, the radial folds being of variable depth decreasing from the inner to the outer periphery of the formed annulus.

3 Claims, 4 Drawing Figures

METHOD OF FORMING A CORRUGATED ANNULUS

BACKGROUND OF THE INVENTION

A sheet metal annulus has general utility when the structure has to be reinforced to obtain resistance to bending. It may, for example, be used as a tank baffle or as the end or head of a reel. In the latter case, an annulus for a reel or the like of heavy construction has usually been formed in arcuate sections with the corrugations in the sections and then several pieces of sections have been welded together to form an annulus as is shown in British Pat. No. 1,187,651 published Apr. 15, 1970. In other instances a strip of metal has been crimped with rectangular formation corrugations of uniform depth and then the outer surfaces of these corrugations have been brought together by folding in a second step to give a circular formation for a reel head where the head is then a complete annulus but formed in two steps as in U.S. Pat. No. 2,928,623. Other variations have also been tried such as corrugating a circular blank as seen in U.S. Pat. No. 3,736,787.

SUMMARY OF THE INVENTION

A flat strip of metal of indefinite length is fed into a corrugating machine which performs an operation of bending the stock at right angles to its thickness with a tool having a taper from edge to edge of varying depth and then bends the stock again about the tapered edge of the first tool by engagement of a second tool to provide a wall substantially parallel to the wall of the first bend and of the same tapered depth as the first end and back into the line of feed of the strip stock. In doing so, the varying depth tends to cause the stock to form an arc and the whole machine having the tools which operate upon the stock rotates through a certain arc to compensate for the arcuate formation of the stock as occurs during the varying or tapered rib or corrugation which is formed in the stock, this being completed in step by step operation until a partial or complete annulus of the stock is formed and then the strip is cut off, the stock removed from the machine, and the two ends of an annulus thus formed secured together as by welding. A helix may also be formed by the machine and in this case the helix may be secured in a cylinder, as a baffle, for example.

DESCRIPTION OF THE PREFERRED EMBODIMENT

Figure 1:
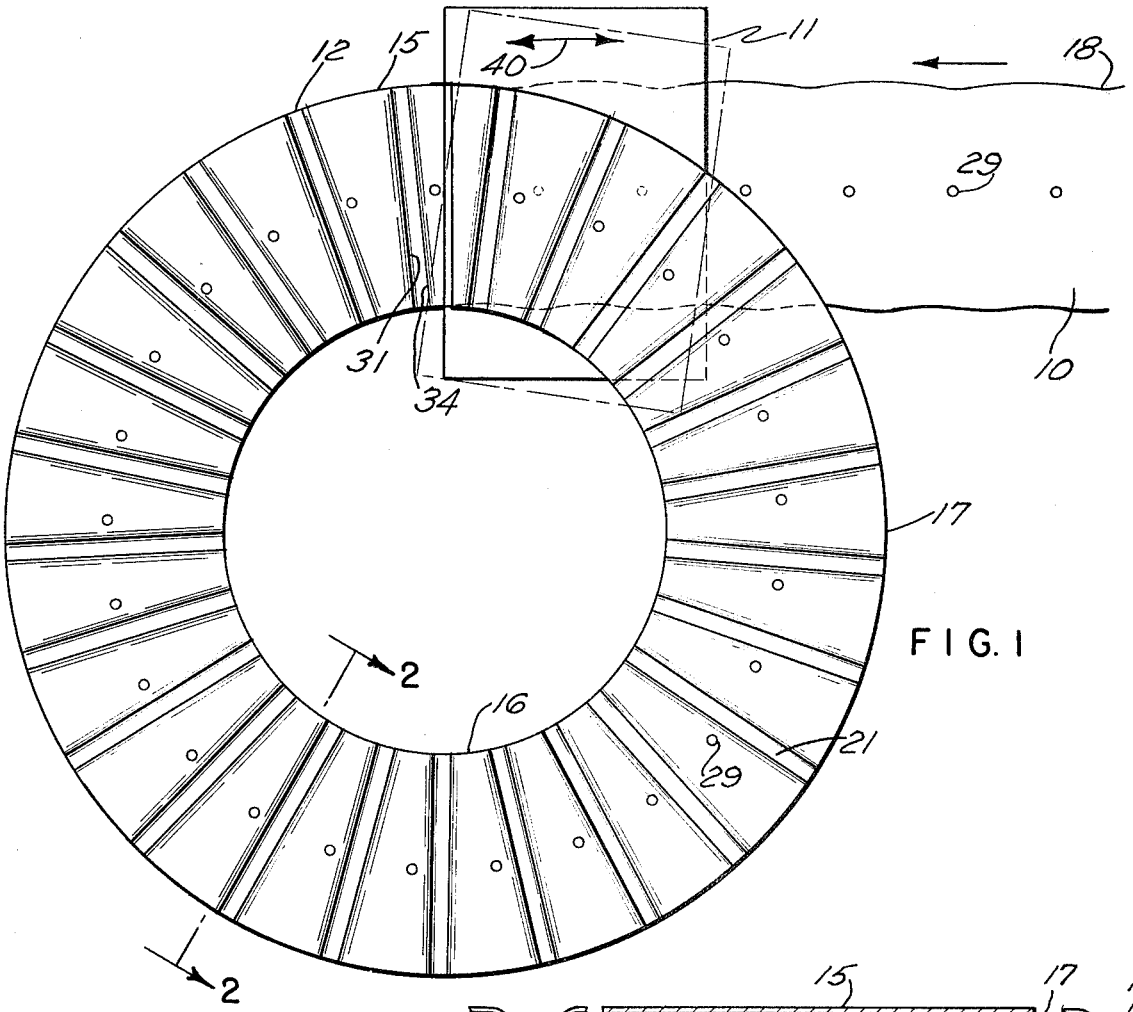
FIG. 1 is a top plan diagrammatic view illustrating a strip of stock as being fed into a machine, shown by a rectangular block, the rotation of the entire machine illustrated by a double arrow.
Figure 2:
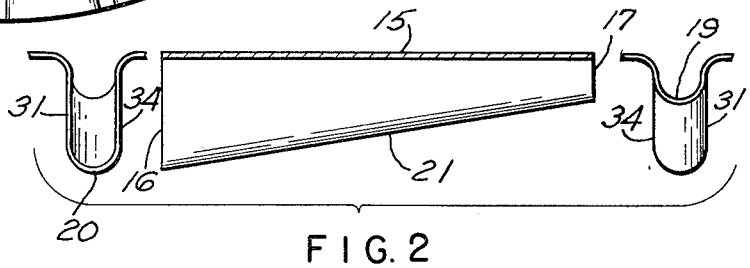
FIG. 2 is a sectional view on line 2—2 of FIG. 1 and illustrating at each end of the section an end view of the stock in this formation.

With reference particularly to FIG. 1, 10 designates a strip of stock of endless length and of varying width (depending on requirements) as it comes from an edge scalloping and perforating machine to the machine of this invention. The strip of stock 10 is fed into a machine generally designated 11, which is rotatably mounted on an axis perpendicular to the stock, where corrugations designated 12 are placed in the strip of stock. The stock emerges from the machine in a continuous arcuate form until the desired arcuate length is formed, the stock moving over the top of the machine at the end of its run. In most applications a complete annulus is desired. Assuming, therefore, a complete annulus is formed, there is a cutter which cuts off the strip of stock and the annulus is removed from the machine for attachment of the free ends and may be used further in the formation of the heads of a wire reel. The corrugations which are generally designated 12 and shown in the section FIG. 2 are of tapered form, the upper surface 15 being the portion between corrugations and the corrugations (FIG. 2) being of a much greater depth at one edge 16 than at the other edge 17. The greater depth is at the inside of the circle of the annulus, whereas the more shallow depth 17 is at the outer periphery of the annulus. The stock is scalloped as seen at 18 in the strip 10 so that as portions of the stock are bent, the edge of the annulus will form a perfect circle on the inside and outside of the strip and the edges 16, 17 will be at right angles to the plane of surface 15.

It is further seen from the end view of FIG. 2 that the bottom curve of the corrugation as at 19 is of substantially the same curvature at the outer periphery of the annulus as is the curvature 20 at the inner curvature of the annulus. Although the varying depth of the corrugation at 21 is quite substantial, it is because of this varying depth that the strip of stock takes the curved formation as seen in FIG. 1.

Figure 3:
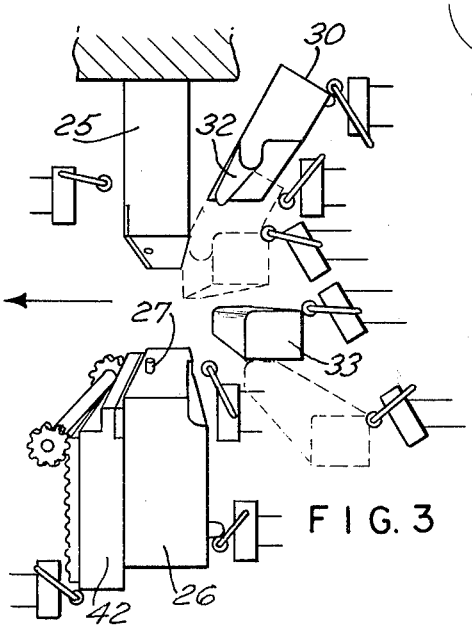
FIGS. 3 and 4 are diagrammatic views illustrating some of the details of the movement of the tools on the stock and a means for clamping the stock in the machine shown by the block diagram of FIG. 1.
Figure 4:
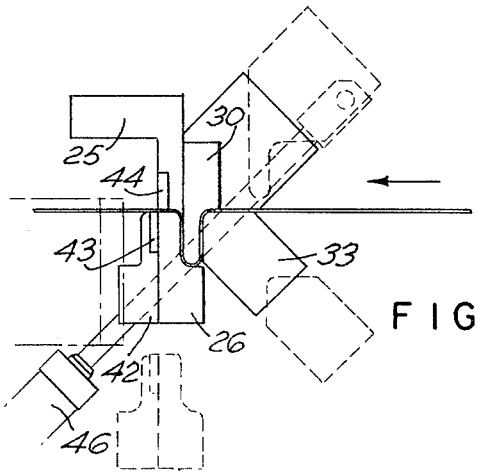

Referring now to FIGS. 3 and 4, there are two clamping tools 25 as an upper tool and 26 a lower tool. The stock is prepierced with a pilot hole 29 (FIG. 1) and the spacing between the holes 29 determines the spacing of the corrugations 21. This lower tool 26 is provided with a pin 27 which will engage a locating opening 29 in the strip of stock. These tools 25, 26 clamp the stock in alignment and hold it while it is being operated upon in machine 11. After the stock is clamped, a tool 30 is moved in to bend the strip of stock so as to form the wall 31 (FIG. 2) at substantially a right angle to the longitudinal extent of the stock. This tool 30, however, is tapered at its edge 32 so as to extend a greater extent on the inner edge of the annulus than on the outer edge, and as the tool 30 is operating to bend the stock in this manner, the entire machine will rotate in an arc of x° due to the taking up of the stock material and the variable depth of the bend. It is advantageous to use a coordinated power assist, the rotating being counterclockwise as seen in FIG. 1. A second tool 33 is then moved in to bend the stock back and form the wall 34 of the corrugation. While this bending occurs, further counterclockwise movement of the machine is again caused by taking up more stock material. As before, power assist is desirable to help the rotation which shall be designated as an arc of y°. This bending by the second tool 33 about the first tool serves to completely form tapered corrugations along the line 24 as shown in FIG. 2. It will therefore be apparent that in the first bending operation the stock is formed by the tool 30 against tool 26 causing a partial arc and in a similar fashion as tool 33 operates against tool 30, a further arc is created so that the central line of movement of the strip of stock 10 is essentially in a straight line. The two clamping tools and the two bending tools are operated by fluid cylinders, usually hydraulic, although air might be used. By way of example one such cylinder is shown at 46 (FIG. 4). It will be understood, however, other linear operators may be substituted. After the tools have operated upon the stock, the tools 30 and 33 are moved to their retracted positions and the clamping tools 25 and 26 are released to move away from the stock. The machine is now rotated as shown by arrow 40 in a clockwise direction. Tool 33 is now moved upwardly as seen in the drawing to provide a platform for the stock. Then the stock is fed forward with the arcuate portion extending in a curved fashion from the machine. The rotation as shown by the arrow 40 is through an arc substantially the distance equal to $x^\circ + y^\circ$. The cycle is repeated and the clamping tools are again brought together with their pin 27 in the next opening. This succession of operations, with a small rotation of the machine in an arc to form the corrugations, is continued until a partial or complete annulus or even a helix is formed whereupon a severing of the strip takes place. The machine is then positioned where the tooling is on a radius of the formed stock and tool 42 with shear blade 43 is moved upwardly to act against blade 44 on tool 25 and the formed strip is removed from the machine. If a complete annulus is formed the ends of the annulus may be attached together such as by welding and may be further used, as for example, for a reel head by placing bands about its outer and inner edges and combining the entire annulus with its rims thus formed with the barrel of a reel as illustrated in U.S. Pat. No. 3,565,363 and British Specification No. 1,218,829.

I claim:

1. The method of forming a radially convoluted partial annulus from flat strip stock wherein a first and second forming tool is mounted on a rotatable assembly which comprises clamping the stock, a first tapered tool engaging and bending the stock laterally of its longitudinal extent at substantially right angles to provide a first corrugated wall as said assembly rotates a finite amount in a first direction, then while holding the bent stock in the bent position, oppositely bending the stock about the engaged first tapered tool by a second tool while allowing said assembly of the tools to rotate a further amount to substantially provide a second wall of a corrugation substantially parallel to the first wall, the corrugation being tapered to extend a greater depth at one edge than the other, said stock taking an arcuate form in generally the plane of feed as it exits the assembly, then releasing the stock and rotating the assembly of both bending tools in a reverse direction relative to the stock, feeding the stock forwardly and again clamping the stock and performing the first and second bending operations and repeating until at least a partial annulus is formed.

2. The method of claim 1 including forming a complete annulus and severing the strip stock.

3. The method of claim 1 wherein the rotation of the assembly of bending tools is back and forth through an arc about an axis perpendicular to the plane of the strip, the multiple of which will provide a complete annulus.

* * * * *